US008892335B2

(12) United States Patent
Schremmer

(10) Patent No.: US 8,892,335 B2
(45) Date of Patent: Nov. 18, 2014

(54) METHOD FOR CONTROLLING A CORONA IGNITION DEVICE

(75) Inventor: Torsten Schremmer, Ludwigsburg (DE)

(73) Assignee: BorgWarner BERU Systems, GmbH, Ludwigsburg (DE)

( * ) Notice: Subject to any disclaimer, the term of this patent is extended or adjusted under 35 U.S.C. 154(b) by 195 days.

(21) Appl. No.: 13/542,357

(22) Filed: Jul. 5, 2012

(65) Prior Publication Data

US 2013/0013167 A1 Jan. 10, 2013

(30) Foreign Application Priority Data

Jul. 7, 2011 (DE) ..... 10 2011 051 635

(51) Int. Cl.

| | |
|---|---|
| ***F02P 23/04*** | (2006.01) |
| ***F02P 9/00*** | (2006.01) |
| ***F02P 3/01*** | (2006.01) |
| *F02P 3/04* | (2006.01) |

(52) U.S. Cl.

CPC ..... *F02P 23/045* (2013.01); *F02P 3/04* (2013.01); *F02P 9/007* (2013.01); *F02P 3/01* (2013.01)

USPC ..... 701/102; 123/606

(58) Field of Classification Search

CPC ..... F02P 9/007; F02P 23/04; F02P 3/01; F02P 3/04; F02P 23/045

USPC ..... 701/102, 113; 123/606, 607, 608, 123/143 B, 598

See application file for complete search history.

(56) References Cited

U.S. PATENT DOCUMENTS

| | | | | |
|---|---|---|---|---|
| 6,883,507 | B2 * | 4/2005 | Freen | 123/606 |
| 2004/0129241 | A1 | 7/2004 | Freen | |
| 2011/0144071 | A1 | 6/2011 | Grawe et al. | |
| 2011/0253114 | A1 * | 10/2011 | Schremmer | 123/606 |
| 2011/0297132 | A1 * | 12/2011 | Schremmer et al. | 123/598 |
| 2011/0305998 | A1 * | 12/2011 | Toedter et al. | 431/2 |

FOREIGN PATENT DOCUMENTS

| | | | |
|---|---|---|---|
| DE | 10 2009 055 862 | A1 | 6/2011 |
| DE | 102010015344 | A1 | 10/2011 |
| DE | 102010045044 | A1 | 12/2011 |
| WO | WO 2010/011838 | A1 | 1/2010 |

* cited by examiner

*Primary Examiner* — Mahmoud Gimie

(74) *Attorney, Agent, or Firm* — Hackler Daghighian & Martino

(57) ABSTRACT

The invention relates to a method for controlling a corona ignition device which, in a cyclically operating combustion engine, ignites a fuel-air mixture by means of a corona discharge originating from an ignition electrode in that by means of a primary voltage applied to a primary side of a DC/AC converter, an electrical oscillator circuit is excited, which oscillator circuit is connected to the ignition electrode, wherein the impedance on the primary side of the DC/AC converter is successively measured. According to the invention it is provided that by evaluating the impedance measurements, a time of the start of a corona discharge is determined, this time is compared with a target value, and the activation of the primary side of the DC/Ac converter is changed depending on a result of this comparison.

12 Claims, 4 Drawing Sheets

METHOD FOR CONTROLLING A CORONA IGNITION DEVICE

The invention is based on a method generally known from WO 2010/011838 A1.

WO 2004/063560 A1 discloses how a fuel-air mixture in a combustion chamber of an internal combustion engine can be ignited by a corona discharge generated in the combustion chamber. For this purpose, an ignition electrode extends electrically isolated through one of the combustion chamber walls which are at ground potential and protrudes into the combustion chamber, preferably opposite to a piston provided in the combustion chamber. The ignition electrode forms a capacitance together with the combustion chamber walls which are at ground potential and act as counter electrode. The combustion chamber with its content acts as a dielectric. Depending on the actual stroke of the piston, air or a fuel-air mixture or an exhaust gas is contained in said combustion chamber.

The capacitance is an integral part of an electrical oscillator circuit which is excited with high-frequency voltage which is generated, for example, by means of a transformer with a center tap. The transformer cooperates with a switchgear which alternately applies a predeterminable direct voltage to the two primary windings of the transformer which are connected through the center tap. The secondary winding of the transformer feeds a series oscillator circuit of which the capacitance formed by the ignition electrode and the combustion chamber walls is part of. The frequency of the alternating voltage exciting the oscillator circuit and fed by the transformer is controlled such that it comes as close as possible to the resonance frequency of the oscillator circuit. This results in a voltage over-shoot between the ignition electrode and the walls of the combustion chamber in which the ignition electrode is arranged. The resonance frequency typically lies between 500 kilohertz and 6 megahertz, and the alternating voltage at the ignition electrode reaches values of, e.g., 50 kV to 100 kV.

Thus, a corona discharge can be generated in the combustion chamber. The corona discharge should not break down into an arc discharge or spark discharge. Therefore the voltage between the ignition electrode and the ground is kept below the voltage for a complete breakdown. For this purpose, it is known from WO 2004/063560 A1 to measure the voltage and the current at the input of the transformer and to calculate therefrom the impedance as the quotient of voltage and current. The calculated impedance is compared with a target value for the impedance which is selected such that the corona discharge can be maintained without the occurrence of a complete voltage breakdown.

From WO 2010/011838 A1 it is known to control the transformer on its primary side by setting a target impedance in that first, at a voltage which is low enough that no corona discharge takes place, a so-called baseline impedance at the input of the transformer is determined. Proceeding from a low voltage, the current-voltage relationship at the input of the transformer is initially linear indicating a constant impedance: the current initially increases proportionally to the voltage. The baseline impedance is characteristic for the respective igniter. Once a certain voltage is exceeded, the impedance increases, which is indicated in that the strength of the current measured on the primary side of the transformer is no longer proportional, but increases more and more slowly with progressing increase of the voltage until a voltage breakdown takes place between the ignition electrode and one of the walls bordering the combustion chamber. In the method known from WO 2010/011838 A1, the target impedance is determined such that it is the sum of the baseline impedance and an additional impedance. The additional impedance is increased in small steps by increasing the voltage until a spark discharge takes place. As soon as a spark discharge is detected, the additional impedance is reduced by a step that is slightly greater than the previous step in order to subsequently avoid further spark discharges and to keep the oscillator circuit in resonance. This makes it possible to keep current and voltage at the input of the transformer below the value at which a spark discharge can occur, and to limit them to a value at which the corona reaches a maximum and therefore effects a reliable ignition of the fuel-air mixture.

SUMMARY OF THE INVENTION

It is an object of the present invention to provide a way on how the ignition behavior of a corona ignition device can be further improved, and the combustion can be optimized.

The object is achieved by a method with the features specified in claim 1. Advantageous refinements of the invention are subject matter of dependent claims.

A corona ignition device ignites in a cyclically operating combustion engine a fuel-air mixture by means of a corona discharge originating from an ignition electrode in that by means of a primary voltage applied to a primary side of a DC/AC converter, an electrical oscillator circuit is excited, which oscillator circuit is connected to the ignition electrode. In one method according to the invention, the impedance on the primary side of the DC/AC converter is continuously measured, and a time of the start of a corona discharge is determined by evaluating the impedance measurements. This point in time is compared with a target value, and the activation of the primary side of the DC/AC converter at a later working cycle of the engine is changed depending on the result of said comparison.

In one method according to the invention, it is possible that for igniting a corona discharge, the impedance is set by closed or open loop control to a target value at which there is an advantageously large corona discharge. Instead of simply assuming that the time of the start of the corona discharge corresponds to the time at which the target value of the impedance is reached, it is according to the invention taken into account that very often, a corona discharge ignites much earlier.

The starting time of a corona discharge is of significant importance for the ignition behavior and also for the combustion, even if the start of a corona discharge often does not coincide with the time of the ignition of the fuel-air mixture in the combustion chamber. The combustion can be optimized by predetermining a target value for the start of the corona discharge. If the time of the start of the corona discharge deviates from a predetermined target value, corrective actions are taken by changing the activation of the primary side of the DC/AC converter.

It is possible here that a deviation of the start of the corona discharge from a target value is considered even during the current working cycle of the engine, for example by slowing down the increase of the primary voltage or the primary current if the start of the corona discharge is too early, or, if the start is too late, by accelerating the increase of the primary voltage or the primary current. The ignition time of a fuel-air mixture depends, among other things, on the amount of energy released through the corona discharge. Thus, by considering the start of the corona discharge, the ignition time can be set to an optimal value.

It is also possible that a deviation of the start of the corona discharge from a target value is considered in a later working cycle of the engine. Through a corrected activation of the primary side of the DC/AC converter it can be achieved that in said later working cycle, the deviation of the start of the corona discharge from the target value is smaller or even disappears completely.

The DC/AC converter can be controlled through the primary current or through the primary voltage. Both possibilities are usually equivalent. The activation of the primary side of the DC/AC converter thus can be changed in that as a control variable, the primary voltage or the primary current is changed.

The point in time of the start of a corona discharge can be determined, for example, in that through evaluation of the impedance measurements, a scatter value is determined which indicates how widely successive results of impedance measurements scatter. The scatter value is then compared with a predetermined threshold value, and if the threshold value is exceeded, it can be concluded that the corona discharge has started.

Another possibility to determine the point in time of a corona discharge provides that a threshold value for the impedance is predefined and from the exceedance of said threshold value, it is concluded that the corona discharge starts. This threshold value can be derived from a basic impedance value, for example, in that the basic impedance value is multiplied by a predefined factor, or a predefined value is added to the basic impedance value. Said basic impedance value is often referred to as baseline impedance and is given by the slope of the current-voltage curve of the primary side of the DC/AC converter of the corona ignition device.

As already mentioned, a good corona discharge can be generated by setting the impedance to a target value. Another possibility is to predetermine a target value for a scatter of successively measured values of the impedance. Details on a corresponding method are described in German Patent Application DE 10 2010 045 044 A1. Such a method is based on the fact that the greater the expansion of the corona discharge, the greater are the fluctuations the impedance. Details on alternative methods by means of which a corona discharge is controlled such that the corona discharge is generated just below the breakdown voltage are described in German Patent Application DE 10 2010 015 344 A1 and German Patent Application DE 10 2010 024 396 A1.

An advantageous refinement of the invention provides that the time of the start of a corona discharge is reported to an engine control unit. In addition, the time of the end of the corona discharge or the duration of the corona discharge can also be reported to the engine control unit. The engine control unit can use this information for optimizing future ignitions or the combustion. For example, the injection time can be attuned to the expected time of the start of the corona discharge.

BRIEF DESCRIPTION OF THE DRAWINGS

The invention is further explained hereinafter by means of the attached schematic drawings.

DETAILED DESCRIPTION

Figure 1:
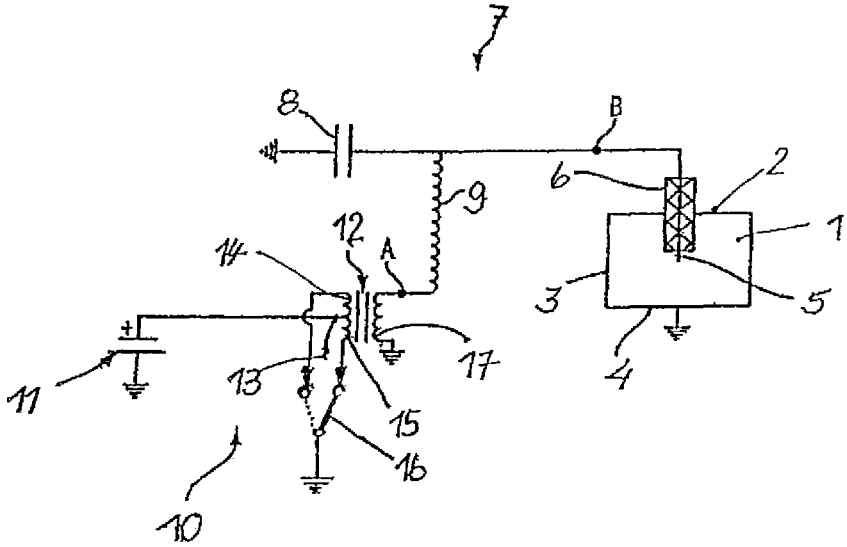
FIG. 1 shows schematically the structure of an ignition system for a vehicle engine.

FIG. 1 shows a combustion chamber 1 which is limited by the walls 2, 3 and 4 which are at ground potential. An ignition electrode 5 protrudes from above into the combustion chamber 1. This electrode is surrounded over a portion of its length by an isolator 6. The isolator electrically isolates the electrode from the upper wall 2 through which it leads into the combustion chamber 1. In the combustion chamber 1, the ignition electrode 5 can protrude out of the isolator 6 or can be covered by a thin isolator layer. The ignition electrode 5 and the walls 2 to 4 of the combustion chamber 1 are integral part of an oscillator circuit 7 which comprises also a capacitor 8 and an inductor 9. Of course, the oscillator circuit 7 can have additional inductors and/or capacitors and other components which are known to the person skilled in the art as possible parts of series circuits.

For exciting the oscillator circuit 7, a high frequency generator 10 is provided which has a direct voltage source 11 and, as a DC/AC converter, has a transformer 12 with a center tap 13 on its primary side so that at the center tap 13, two primary windings 14 and 15 meet one another. By means of a high frequency switch 16, the ends of primary windings 14 and 15, which ends are located remote from the center tap 13, are alternately connected to ground. The switching frequency of the high frequency switch 16 determines the frequency with which the series oscillator circuit 7 is excited, and can be changed. The secondary winding 17 of the transformer 12 feeds the series oscillator circuit 7 at the point A. The high frequency switch 16 is controlled by means of a control circuit (not shown) in such a manner that the oscillator circuit is excited with its resonance frequency. Then, the voltage between the tip of the ignition electrode 5 and the walls 2 to 4, which are at ground, is at its highest.

Instead of a transformer with a center tap, it is also possible to use a transformer, upstream of which an oscillator circuit is arranged which, by switching a transformer with the target frequency, generates at the input of the transformer a voltage characteristic which is not necessarily sinusoidal, but still has a cyclical characteristic with exactly this target frequency.

Figure 2:
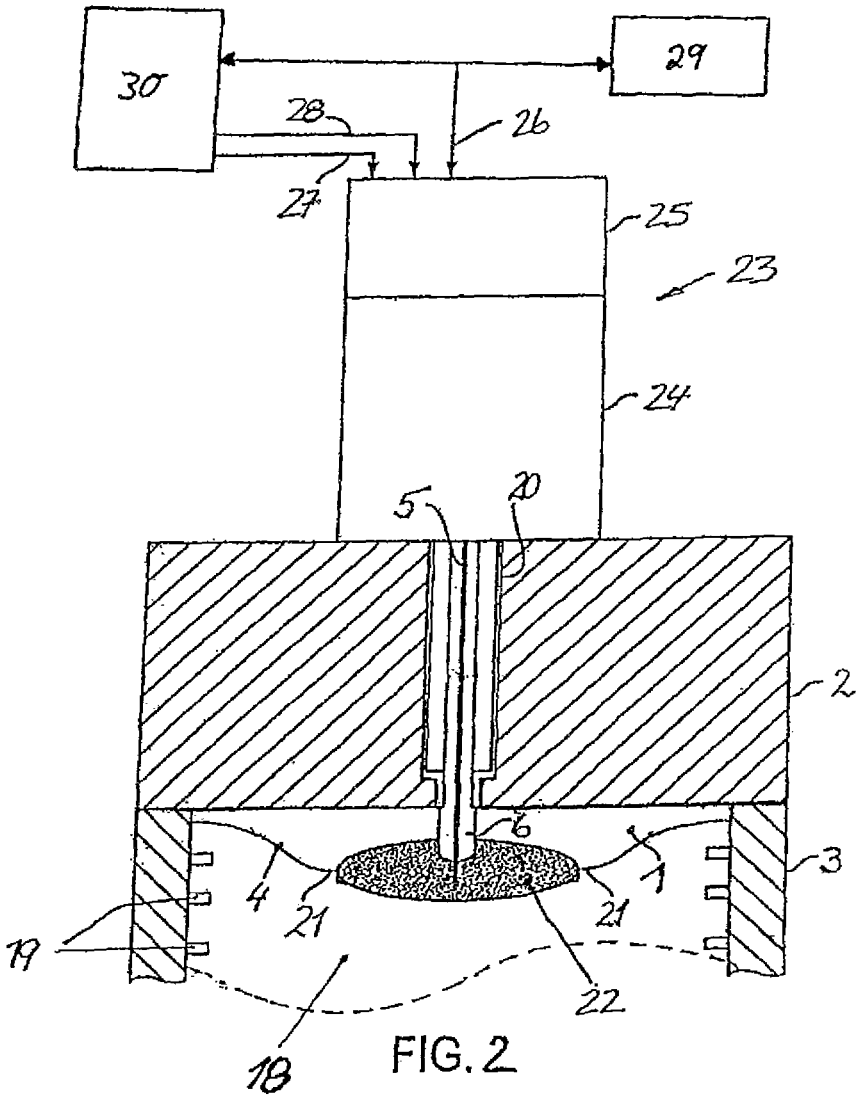
FIG. 2 shows schematically a longitudinal section through a cylinder of an internal combustion engine which is linked to the ignition system illustrated in FIG. 1.

FIG. 2 shows a longitudinal section through a cylinder of an internal combustion engine which is equipped with the ignition device schematically illustrated in FIG. 1. The combustion chamber 1 is limited by an upper wall 2 provided as a cylinder head, by a cylindrical circumferential wall 3, and by the upper side 4 of a piston 18 which is reciprocatingly movable in said cylinder and is provided with piston rings 19.

In the cylinder head 2, there is a passageway 20 through which die ignition electrode 5 extends in an electrically isolated and sealed manner. Moreover, the ignition electrode 5 is surrounded at least over a portion of its length by an isolator 6 which can consist of sintered ceramics, e.g. aluminum oxide ceramics. The ignition electrode 5 projects with its tip into the combustion chamber 1 and protrudes slightly beyond the isolator 6, but could also be flush with the same.

Between the ignition electrode 5 and the piston 18, a corona discharge develops when the oscillator circuit 7 is excited. This corona discharge is accompanied by a more or less intensive charge carrier cloud 22.

On the outer side of the cylinder head 2, a housing 23 is attached. In a first compartment 24 of the housing 23, there are the primary windings 14 and 15 of the transformer 12 and the high frequency switch 16 cooperating therewith. In a second compartment 25 of the housing 23, there are the secondary windings 17 of the transformer 12 and the remaining parts of the series oscillator circuit 7 and, if necessary, means for monitoring the behavior of the oscillator circuit 7. Via an interface 26, it is possible, for example, to establish a connection to a diagnosis unit 29 and/or to an engine control unit 30. However, it is not a must that the transformer 12 is accommodated in a housing attached to the cylinder head 2, but can be accommodated, together with the high frequency switches 16, in a separate ignition control unit which, in turn, can be connected to the engine control unit 30. The remaining parts of the series oscillator circuit can be accommodated in a housing surrounding the isolator 6.

Figure 3:
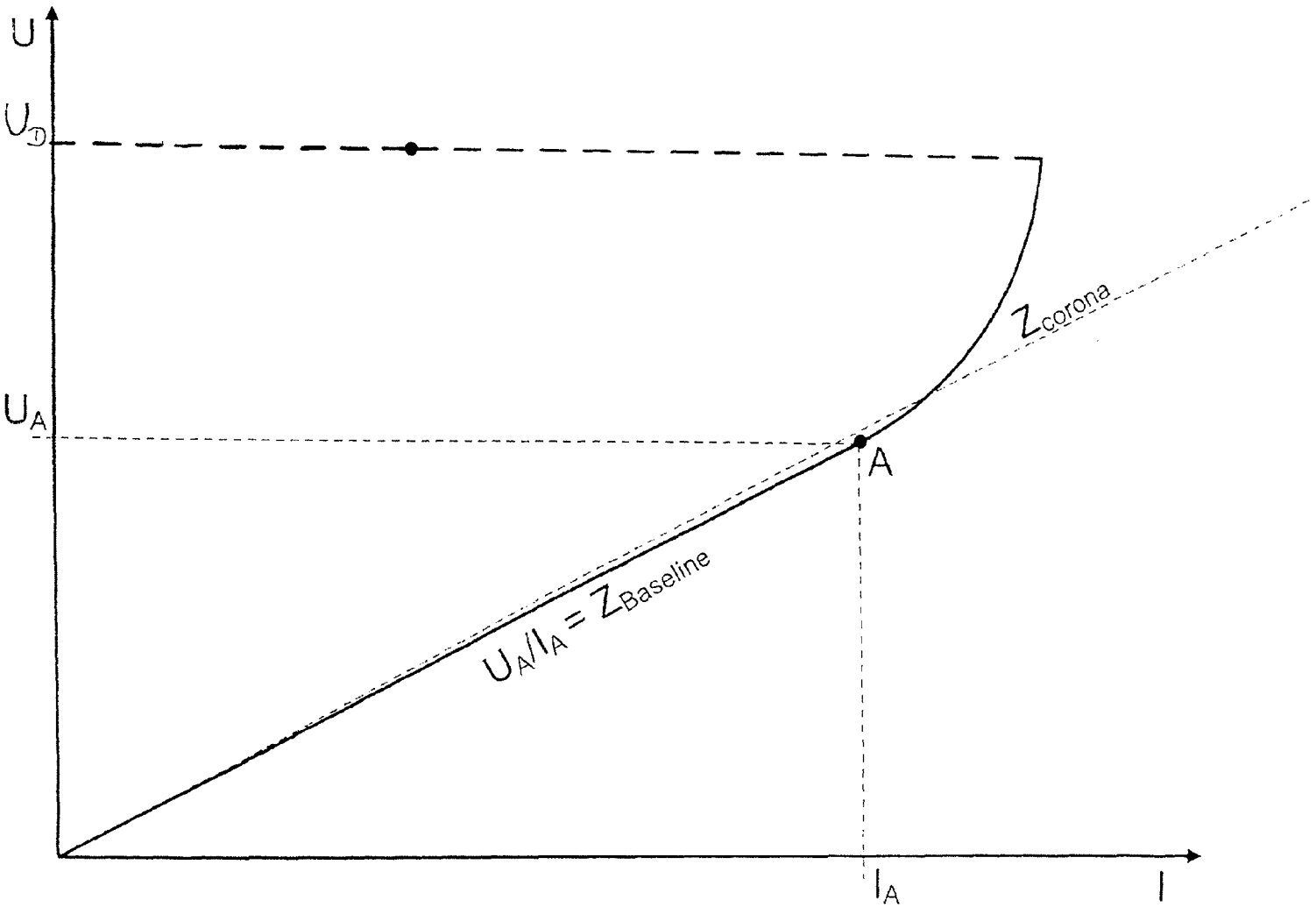
FIG. 3 shows the U/I curve at the input of the DC/AC converter with an impedance threshold value, the exceedance of which indicates the start of a corona discharge.

In FIG. 3, the solid line shows the U/I curve at the input of the transformer 12. By applying a voltage $U_A$ to a primary winding of the transformer, the baseline impedance $Z_{Baseline}$ can be determined according to the equation $$Z_{Baseline}=U_A/I_A$$

For measuring the baseline impedance, the primary voltage $U_A$ is selected such that neither a corona discharge nor a spark discharge occurs, i.e., the point A still lies on the straight portion of the curve. The voltage $U_A$ is considerably lower than the primary voltage $U_D$ at which a voltage breakdown between the ignition between the ignition electrode 5 and a wall of the combustion chamber 1 would occur.

The baseline impedance $Z_{Baseline}$ is a basic impedance value through which a threshold value $Z_{Corona}$ can be defined, the exceedance of which indicates a corona discharge. The threshold value $Z_{Corona}$ can be defined, for example, by multiplying the basic impedance value $Z_{Baseline}$ by a predefined factor or by adding a predefined impedance value to the basic impedance value $Z_{Baseline}$. In FIG. 3, this threshold value $Z_{Corona}$ is drawn as a dashed lined.

In order to determine the start of a corona discharge, the impedance on the primary side of the DC/AC converter can be measured successively by measuring in each case primary current and primary voltage. The shorter the time intervals between the impedance measurements, the more precise the time of the start of a corona discharge can be determined. For example, the impedance can be measured in time intervals of not more than 20 μs, preferably at most 10 μs, in particular 5 is or less. By evaluating the impedance measurements, the time of the start of the corona discharge can be determined in that the measured impedance values are in each case compared with the predetermined threshold value $Z_{Corona}$. If exceedance of the threshold value is detected, it can be concluded therefrom that a corona discharge starts. If after a series of measured impedance values which are smaller than the threshold value $Z_{Corona}$, an impedance value is measured which exceeds the threshold value $Z_{Corona}$, the time of this impedance value can be considered as the time of the start of a corona discharge.

The point in time determined for the start of the corona discharge can then be compared with a target value and the activation of the primary side of the DC/AC converter can be changed depending on the result of said comparison. A correcting change of the activation of the primary side of the DC/AC converter can take place during the current working cycle of the engine or also in a later working cycle.

Figure 4:
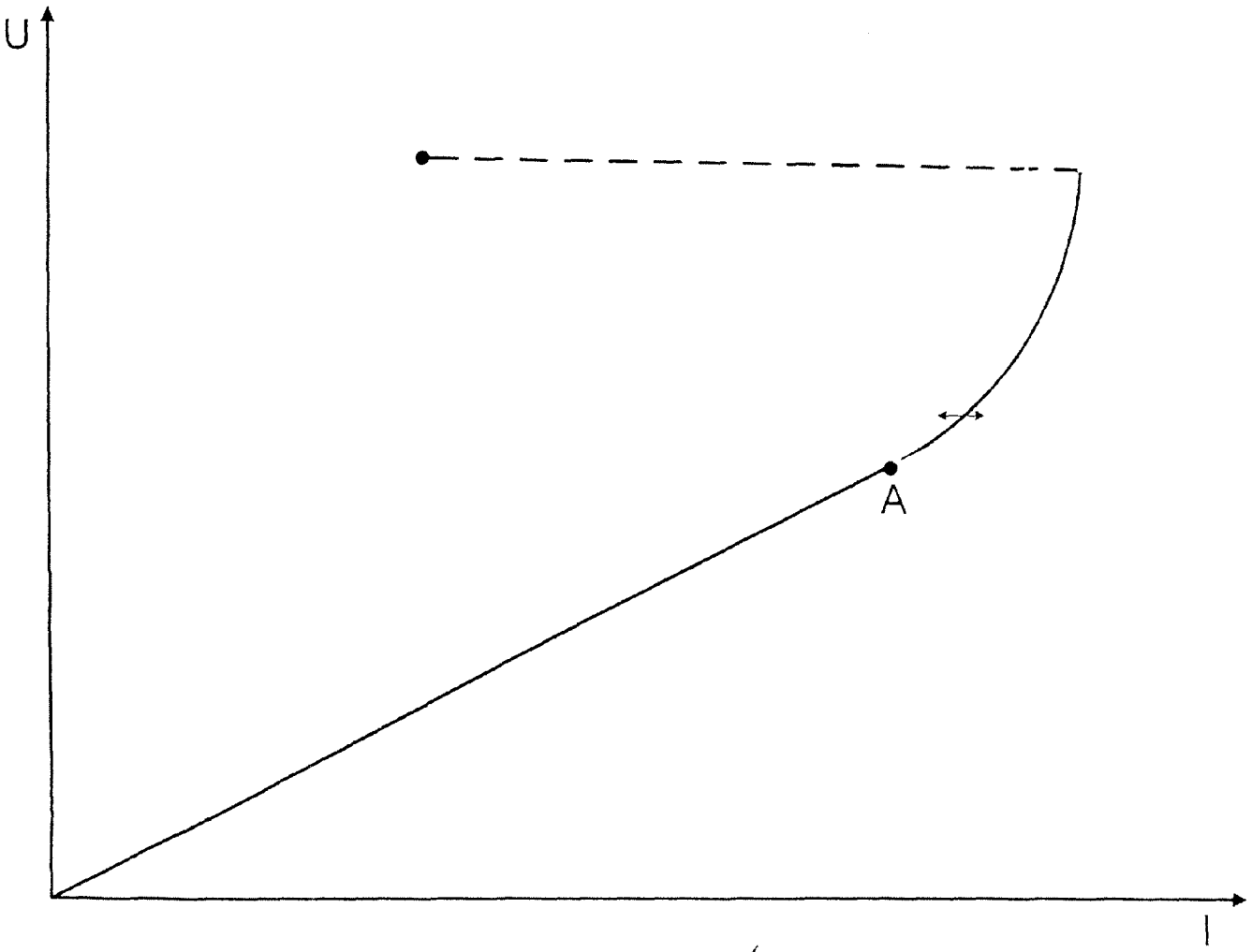
FIG. 4 shows the U/I curve at the input of the DC/AC converter and illustrates the fluctuation of the impedance after the generation of a corona discharge.

An alternative possibility to detect the time of the start of a corona discharge is schematically illustrated in FIG. 4. As FIG. 3, FIG. 4 also shows the U/I curve at the input of the DC/AC converter. As soon as a corona discharge develops, the impedance is subject to major fluctuations. This is indicated in FIG. 4 for the region of the curve to the right of point A. The existence of a corona discharge therefore can also be detected by evaluating the scatter of impedance measurements. For this purpose, first, a scatter value is determined by evaluating the impedance measurements, which scatter value indicates how widely successive results of impedance measurements scatter. The scatter value is compared with a predetermined threshold value. An exceedance of said threshold value indicates the start of a corona discharge.

REFERENCE LIST

1 Combustion chamber
2 Wall
3 Wall
4 Wall (upper side)
5 Ignition electrode
6 Isolator
7 Oscillator circuit
8 Capacitor
9 Inductor
10 High frequency generator
11 Direct voltage source
12 DC/AC converter
13 Center tap
14 Primary winding
15 Primary winding
16 High frequency switch
17 Secondary winding
18 Piston
19 Piston ring
20 Passageway
22 Charge carrier cloud
23 Housing
24 Compartment
25 Compartment
26 Interface
29 Diagnosis unit
30 Engine control unit

What is claimed is:

1. A method for controlling a corona ignition device which, in a cyclically operating combustion engine, ignites a fuel-air mixture by means of a corona discharge originating from an ignition electrode in that by means of a primary voltage applied to a primary side of a DC/AC converter, an electrical oscillator circuit is excited, which oscillator circuit is connected to the ignition electrode, the method comprising:

measuring the impedance on the primary side of the DC/AC converter evaluating the impedance measurements;

determining a time of the start of a corona discharge;

comparing the time of the start of the corona discharge with a target value; and changing the activation of the primary side of the DC/AC converter depending on a result of this comparison.

2. The method according to claim 1, wherein the impedance is measured in time intervals of not more than 20 μs.

3. The method according to claim 1, wherein the impedance is measured in time intervals not more than 10 μs.

4. The method according to claim 1, wherein depending on the result of said comparison, the activation of the primary side of the DC/AC converter is changed at a later working cycle of the engine.

5. The method according to claim 1, wherein depending on the result of said comparison, the activation of the primary side of the DC/AC converter is changed during the current working cycle of the engine.

6. The method according to claim 1, wherein by evaluating the impedance measurements, a scatter value is determined which indicates how widely successive results of impedance measurements scatter, the scatter value is compared with a predetermined threshold value, and from an exceedance of said threshold, it is concluded that a corona discharge starts.

7. The method according to claim 1, wherein a threshold value ($Z_{corona}$) for the impedance is predefined and from an exceedance of said threshold value ($Z_{corona}$), it is concluded that a corona discharge starts.

8. The method according to claim 7, wherein the threshold ($Z_{corona}$) is determined by multiplying a basic impedance value ($Z_{Baseline}$) by a predetermined factor.

9. The method according to claim 8, wherein the threshold value ($Z_{corona}$) is determined by adding a predetermined value to a basic impedance value ($Z_{Baseline}$).

10. The method according to claim 1, wherein the time of the start of a corona discharge is reported to an engine control unit.

11. The method according to claim 1, wherein the impedance is set to a target value at which a corona discharge is expected.

12. A method for controlling a corona ignition device which, in a cyclically operating combustion engine, ignites a fuel-air mixture by means of a corona discharge originating from an ignition electrode in that by means of a primary voltage applied to a primary side of a DC/AC converter, an electrical oscillator circuit is excited, which oscillator circuit is connected to the ignition electrode, the method comprising:

measuring the impedance on the primary side of the DC/AC converter;

evaluating the impedance measurements by determining a scatter value which indicates how widely successive results of impedance measurements scatter;

comparing the scatter value with a predetermined threshold;

concluding that a corona discharge starts from an exceedance of said threshold;

comparing the time of the start of the corona discharge with a target value; and changing the activation of the primary side of the DC/AC converter depending on a result of this comparison.

* * * * *